US006435777B1

(12) United States Patent
Yoshii et al.

(10) Patent No.: US 6,435,777 B1
(45) Date of Patent: Aug. 20, 2002

(54) METHOD OF ARRANGING REINFORCEMENT IN FORMING FOUNDATION OF GROUND REINFORCING TYPE AND FOUNDATION BODY

(75) Inventors: Yukio Yoshii; Shigeru Tanabe; Masayoshi Iijima, all of Tokyo; Hideo Sekino, Gifu, all of (JP)

(73) Assignees: Tokyo Electric Power Company, Tokyo; Dai-Nippon Construction, Gifu, both of (JP)

( * ) Notice: Subject to any disclaimer, the term of this patent is extended or adjusted under 35 U.S.C. 154(b) by 0 days.

(21) Appl. No.: 09/423,443

(22) PCT Filed: May 12, 1997

(86) PCT No.: PCT/JP97/01591

§ 371 (c)(1),
(2), (4) Date: Jan. 11, 2000

(87) PCT Pub. No.: WO98/51868

PCT Pub. Date: Nov. 19, 1998

(51) Int. Cl.[7] ..... E02D 5/54; E02D 27/50
(52) U.S. Cl. ..... 405/244; 405/232; 405/231
(58) Field of Search ..... 405/229, 230, 405/231, 239, 244

(56) References Cited

U.S. PATENT DOCUMENTS 2,203,978 A * 6/1940 Bertran ..... 405/244
4,038,827 A * 8/1977 Pryke ..... 405/244
5,039,256 A * 8/1991 Gagliano ..... 405/244
5,975,808 A * 11/1999 Fujita ..... 405/244

FOREIGN PATENT DOCUMENTS

| | | |
|---|---|---|
| JP | 62-19703 | 5/1987 |
| JP | 5-40085 | 6/1993 |
| JP | 5-57370 | 8/1993 |

OTHER PUBLICATIONS

"Numerical Study On Uplift Bearing Capacity of Caisson Type Pile With Reinforcing Bars", T. Nakia, Nagoya Institute of Technology, Nagoya, Japan; M. Ueno, Dai Nippon Construction, Tokyo, Japan; IS Kyusys (1996); Nov. 12, 1996.

* cited by examiner

*Primary Examiner*—Heather Shackelford
*Assistant Examiner*—Frederick L. Lagman
(74) *Attorney, Agent, or Firm*—Rabin & Berdo, P.C.

(57) ABSTRACT

The present invention particularly relates to a foundation body and method of disposing additional reinforcing materials in foundations formed with a reinforced base which obtains a high underpinning strength with respect to detaching loads. The natural ground 4 is excavated. A plurality of rod shaped additional reinforcing materials are fixed in the peripheral earth which extend radially from the formed main foundation body and which are disposed at fixed intervals in the radial direction. The additional reinforcing materials are disposed so as to be corresponded with the direction of minimum principal strain in the earth peripheral with respect to the foundation body when a detaching force acts.

6 Claims, 12 Drawing Sheets

PRIOR ART

PRIOR ART

PRIOR ART

PRIOR ART

PRIOR ART

PRIOR ART

METHOD OF ARRANGING REINFORCEMENT IN FORMING FOUNDATION OF GROUND REINFORCING TYPE AND FOUNDATION BODY

FIELD OF THE INVENTION

The present invention relates to an underpinning reinforcing means for foundations in civil engineering projects and buildings.

BACKGROUND TO THE INVENTION

The underpinning strength of foundations in civil engineering projects and buildings is achieved by the peripheral base exerting a resistive force on the foundation when an external force is applied to the foundation. The present applicant has disclosed a foundation body and method of forming foundations, which increase underpinning strength in JP-A-5-40085.

In the disclosed method of forming foundations, as shown in FIGS. 8 and 9, a foundation body 1 disposes an additional reinforcing materials 3 comprised of bar steel in the periphery of a deep main foundation body 2. The additional reinforcing materials 3 extends radially from the deep main foundation body 2 in a horizontal sloping direction and is disposed plurally in the axial direction at fixed intervals. Each body is fixed into the peripheral natural ground 4.

The foundation body 1 is formed by the method outlined below. Firstly in order to form the main foundation body 2, the natural ground 4 is excavated in a fixed diameter and fixed depth in the vertical direction. A liner plate 6 is used to protect the excavation surface 7. Next the additional reinforcing materials 3 are fixed in the natural ground 4 from an opening portion 5 provided beforehand at a fixed position in the liner plate 6 in the order as shown in FIGS. 10–14. In other words, firstly boring into the natural ground 4 is performed from the opening portion 5 as shown in FIG. 10. As shown in FIG. 11, a hollow tube 9, for fixation of a tip and into which the additional reinforcing materials 3 is previously inserted, is inserted into a hole 8. The additional reinforcing materials 3 are longer than the hole 8 and the tip is expanded in a tapered shape to form a wedge 10. Furthermore the hollow tube 9 is constituted by a pipe body 11 and a fixing tube 12 which is freely attachable and detachable from the tip. The fixing tube 12, as shown in FIGS. 15 and 16, has a tapered portion 13 having the internal diameter of which is expanded toward the tip and a plurality of slits 14 formed in the axial direction from the tapered portion 13. After the additional reinforcing materials 3 and the hollow tube 9 are inserted, as shown in FIG. 12, an extraction force is applied to the additional reinforcing materials 3 while the presser tool 15 compresses the base side of the hollow tube 9. The fixing tube 12 is drawn into the natural ground 4 by the wedge 10 of the additional reinforcing materials 3 compressively expanding the tapered portion 13 of the fixing tube 12. Hence the additional reinforcing materials 3 cannot be detached. After this, as shown in FIG. 13, if a hardening agent 16 is poured while the pipe body 11 of the hollow tube 9 is cut and detached from the fixing tube 12, the additional reinforcing materials 3, as shown in FIG. 14, will leave a basal ends 17 which projects toward the center of the main foundation body 2 and will be fixed on all sides in the hole 8. In this way, the additional reinforcing materials 3 is fixed radially in the base in the horizontal and oblique direction at various depths.

Next while avoiding the basal ends 17 of the additional reinforcing materials 3 which projects from the natural ground 4, assembly of reinforcing rods of the main foundation body 2 is performed. After this, a fixed plate 18 is secured to basal ends 17 on the inner side of the reinforcing structure as shown in FIG. 17 and FIG. 18. The fixed plate 18 is welded to the axial reinforcing rod 19 and a lateral reinforcing rod 20 and the head of the basal ends 17 is secured to the fixed plate 18 by a fixing nut 21. As regards the additional reinforcing materials 3 which are disposed in an oblique direction in FIG. 8, a fixed metal element 18A, triangular in cross section such as that shown in FIG. 19, may be used instead of the fixed plate 18 to fix the basal ends 17. In this way, after securing the basal ends 17 of each additional reinforcing materials 3 to the reinforcing rods 19 and 20, the foundation body 1 as shown in FIGS. 8 and 9 can be formed by placing the concrete of the main foundation body 2.

In a foundation body 1 formed in this way, the additional reinforcing materials 3 is strongly integrated with the natural ground 4 due to the adhesive force of the hardening agent 16 plugging the periphery and the securing force to the natural ground 4 as a result of the wedge 10 resisting detachment. Thus the base in the periphery of the additional reinforcing materials 3 is strengthened. On the other hand, the basal ends 17 is rigidly attached to the main foundation body 2 due to being fixed to the reinforcing rods 19 and 20 of the main foundation body 2. As a result, the foundation body 1 functions as a single foundation containing a peripheral base 22. The surface on which shear resistance s acts when an extraction force Fv acts on the main foundation body 2 is the imaginary underpinning surface 23 connecting the tip of each additional reinforcing materials 3 as shown in FIG. 20. Hence the surface area on which shear resistance s acts is conspicuously expanded and the underpinning strength with respect to an extraction force is greatly increased.

Furthermore the underpinning structure with respect to a horizontal force Fh is strengthened as shown in FIG. 21. In other words, the surface on which the passive earth pressure $p_1$ and the elastic base reactive force $p_2$ act is expanded to an imaginary support surface 24 of the semicircular cross section connecting the tips of each additional reinforcing materials 3 which are disposed in the left half of the main foundation body 2 in the figure. Thus since the base 22 is strengthened by the additional reinforcing materials 3, the range of the layers of earth B which obtain the elastic base reactive force $p_2$ is expanded in the upward direction. The resistance a of the additional reinforcing materials 3, which is disposed in the right middle half of the figure of the main foundation body 2, acts as an underpinning force with respect to extraction forces. Therefore the foundation body 1 obtains an extremely strong underpinning force with respect to horizontal forces Fh.

However in this type conventional foundation body and method for forming foundations, since there is no accurate standard for the method of placement of the additional reinforcing materials 3 with respect to the foundation body 1, in other words the extension of the additional reinforcing materials 3, it is not always possible to obtain a sufficient application of the reinforcing underpinning due to the additional reinforcing materials 3. In other words, in foundations such as those of high voltage electricity towers for example, underpinning forces with respect to extractive forces are more of a problem than compressive forces. However even if it is attempted to create reinforced underpinning forces which resist a detaching force on the foundation body 1, it has not been possible to create an accurate method of placing the additional reinforcing materials 3.

The present invention is proposed to solve the above problems and has the objective of providing a foundation body and method of disposing an additional reinforcing material in foundations with a reinforced base which obtains a reinforced underpinning force especially with respect to detaching loads.

DISCLOSURE OF THE INVENTION

The present invention provides a method of forming foundations with a reinforced base by boring into the earth from the excavation surface of the foundations. After a highly rigid additional reinforcing material is fixed into the bore, the base of the additional reinforcing material is fixed to the main foundation body and the main foundation body is formed. The resistance of the foundation body with respect to tensile forces is strengthened by the structural apportioning by the additional reinforcing material of a part of the shear stress and the tensile stress with respect to the earth. Thus for each additional reinforcing material:

$$\Delta pr=(N\max.\ \cos\Theta)+S\max.\ \sin\Theta).\ \tan\Phi$$

where Nmax is the maximum axial force of the additional reinforcing material, Smax is the maximum shear force of the additional reinforcing material, $\Theta$ is the angle of placement of the additional reinforcing material, $\Phi$ is the inner frictional angle of the base.

As a result, the total reinforcing effect $\Delta p$ which expresses the underpinning strength of the foundation body is the result of the increase in the resistance $\Delta ps$ due to the structural effect generated by the structural apportioning by each additional reinforcing material itself of a part of the tensile stress and the shear stress with respect to the earth and the increase in the resistance $\Delta ps$ due to the effect of the reinforcing effect which is expressed as $$\Delta p=\Delta ps+\Delta pr$$

In the present invention, as the additional reinforcing material is disposed so as to maximize the increase in the resistance $\Delta pr$, the total reinforcing effect $\Delta p$ increase due to the increase in the confining pressure with respect to the foundation body increases. Thus the foundation body is supported in an extremely strong manner in the earth.

Thus the present invention is effective for use in high voltage electrical towers which entail the problem of underpinning strength withstanding detaching forces. While keeping the foundation body to small dimensions, the underpinning strength due to the reinforcing effect is conspicuously improved. Hence the cost of the foundation construction is greatly reduced, the time required is reduced and the amount of earth removed due to boring is reduced.

Furthermore the present invention provides a method of forming foundations with a reinforced base by boring into the earth from the excavation surface of foundations. After a highly rigid additional reinforcing material is fixed into the bore, the base of the additional reinforcing material is fixed in the foundation body thus forming the main foundation body. The additional reinforcing material may be a bar shaped body. The orientation of the additional reinforcing material is made to correspond with the direction of minimum principal strain in the earth which is the direction in which the tensile axial force of the additional body is at a maximum when a detaching force acts on the foundation body.

Furthermore, this invention provides foundation bodies with a reinforced base constructed from a main foundation body constructed after boring in the earth and additional reinforcing materials which extend in a radial direction from the foundation main bodies. The additional reinforcing materials have a bar shape and have a downward angle of inclination with respect to the axial direction of the main foundation body so that their orientation corresponds to the direction of minimum principal strain in the earth which is the direction in which the tensile axial force of the additional reinforcing material is at a maximum when a detaching force acts on the foundation body.

As a result, the base is strengthened by a plurality of additional reinforcing materials fixed in the earth. Also the base is integrated with the main foundation body as the base part of the additional reinforcing material is fixed to the main foundation body. As a result, the underpinning strength of the foundation body is increased by the structural effect generated by the additional reinforcing material itself structurally apportioning a part of tensile and shear stress with respect to the earth and by the reinforcing effect confining the tensile strain generated by the earth and increasing the rigidity of the entire base. The reinforcing effect is to greatly limit the tendency of the earth to expand and to limit the absolute value of the increase in minimum principal strain during shear fracture of the earth by the additional reinforcing materials which pull the earth in the periphery of the foundation body. The reinforcing effect is also generated by an increase in minimum principal stress. However the effect of the additional reinforcing materials of the present invention drawing the peripheral earth toward the foundation body when a detaching force acts on the foundation body is maximized by their orientation in the direction of minimum principal strain in the earth in the periphery of the foundation body. Therefore in accordance with the present invention, the reinforcing effect as a result of the additional reinforcing materials is maximized. Hence since shear strength with respect to maximum principal stress is increased and the base in the periphery of the foundation body is strengthened, the confining pressure with respect to the foundation body is increased and the foundation body is strongly underpinned by the earth.

Thus the present invention may be employed in high voltage electricity towers which suffer from the problem of underpinning strength with respect to detaching forces. While maintaining small dimensions for the foundation body, the underpinning strength attributable to the reinforcing effect is conspicuously increased. Hence the cost of foundations is greatly reduced, the time required for their placement is reduced and to the degree the foundation body is reduced in size, the amount of extracted earth is reduced.

The present invention is provided with a plurality of additional reinforcing materials which are disposed at roughly equal intervals in the entire periphery of the outer circumference of the main foundation body. As a result it is possible to obtain a high underpinning strength by the additional reinforcing materials.

The additional reinforcing materials of the present invention are approximately ⅔ the length of the diameter of the main foundation body. With these dimensions, it is possible to obtain a high underpinning strength by the additional reinforcing materials.

The additional reinforcing materials of the present invention are disposed at a ratio of one for every 3 square meters in the outer surface of the main foundation body. In this way, maximum efficiency of degree of reinforcement with respect to the number of additional reinforcing materials used can be achieved.

Furthermore foundation main bodies which have a short length in the radial direction are used in the present invention. The additional reinforcing materials are disposed stepwise in the axial direction of the main foundation body. The present invention affords a sufficient strengthening effect with respect to foundations of such a short length.

PREFERRED EMBODIMENTS OF THE INVENTION

The preferred embodiments of the invention will be explained below with reference to the accompanying figures.

Since the present invention has basically the same structure and same method of forming the foundation body as the conventional one shown in FIGS. 8–21, the explanation will center on the points of difference.

Figure 1:
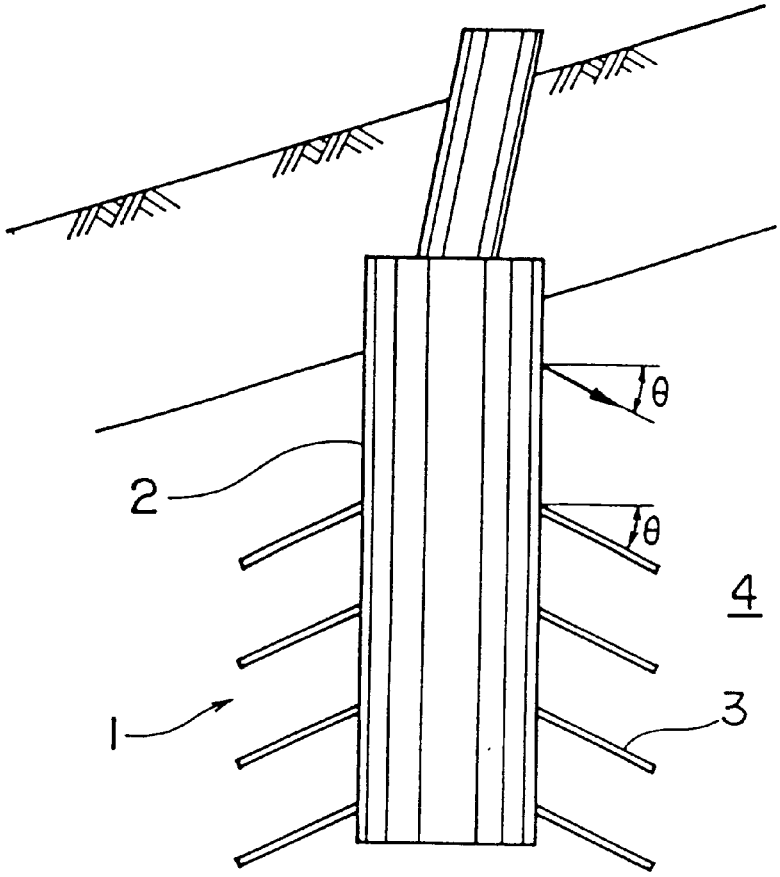
FIG. 1 is a vertical cross section schematically showing the present invention.
Figure 2:
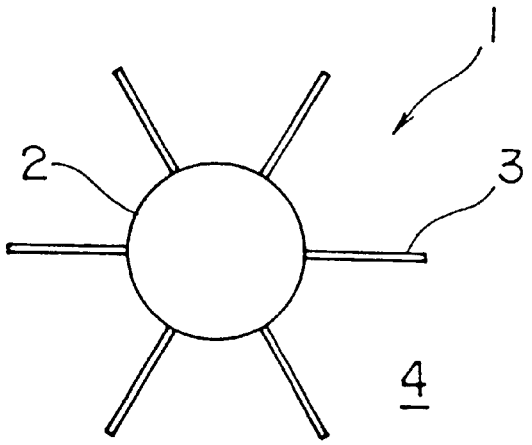
FIG. 2 is a similar horizontal section.

As shown in FIGS. 1 and 2, a plurality of additional reinforcing materials 3 in the form of steel bars are provided extending radially (the direction of the arrow in FIG. 1) in the direction of minimum principal strain in the earth 4 in the periphery of the foundation body 1 when a detaching (extraction) force is applied to the foundation body 1 with respect to the deep main foundation body 2 constructed in a vertical direction. Each additional reinforcing materials 3 is disposed inclining downwardly at an angle of $\theta=\pi/4-\phi/2$ (unit: radian) to the horizontal. Here $\phi$ is the inner frictional angle of the earth in which the foundation body 1 is constructed. For example when the earth is decomposed granite soil, $\phi$ takes a value of approximately 40°. In this case, the direction of orientation of the additional reinforcing materials 3 is approximately 25°.

According to experimental test by using models, the additional reinforcing materials 3 is preferably constructed in a deep earth position such as shown in FIG. 1, that is to say, on the underside of the foundation body 1. In this way, a higher strengthening effect can be achieved. Furthermore it is also possible to increase the strengthening effect by equivalent disposition at roughly equal intervals on the outer periphery of the foundation body 1 as shown in FIG. 2. When the length of the additional reinforcing materials 3 is approximately ⅔ the length of the diameter of the main foundation body 2, a higher reinforcing effect is achieved.

Figure 9:
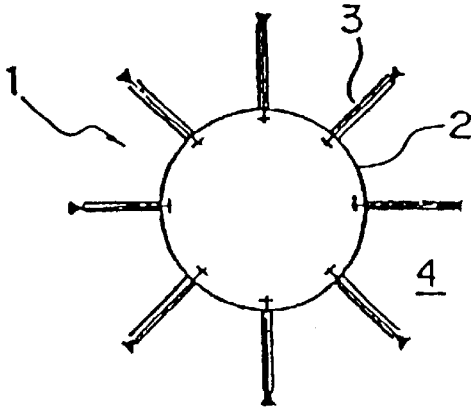
FIG. 9 is a similar vertical section.
Figure 10:
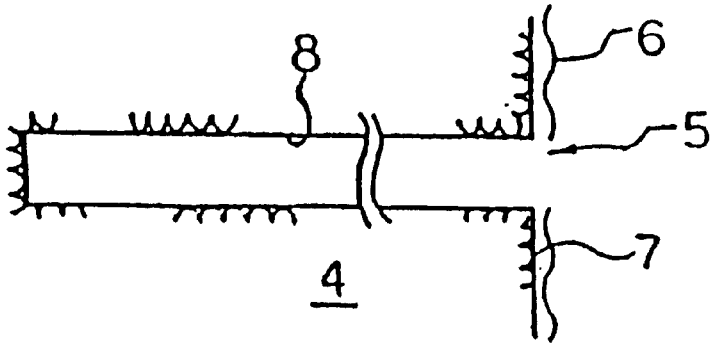
Fig. 10 PRIOR ART
FIG. 10 is a cross section showing the method of fixing the additional reinforcing material used in the foundation body into the earth.
Figure 11:
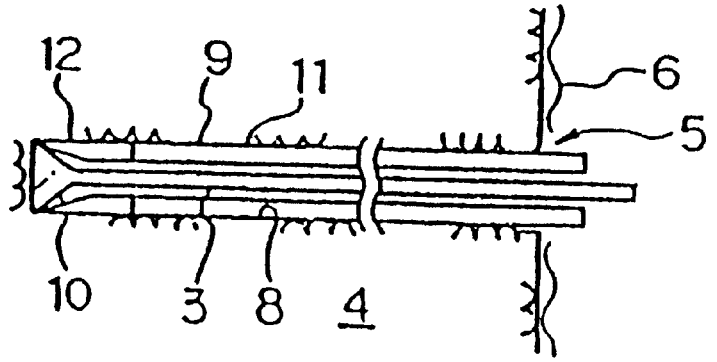
FIG. 11 is a similar cross section showing the method of fixing the additional reinforcing material into the earth.
Figure 12:
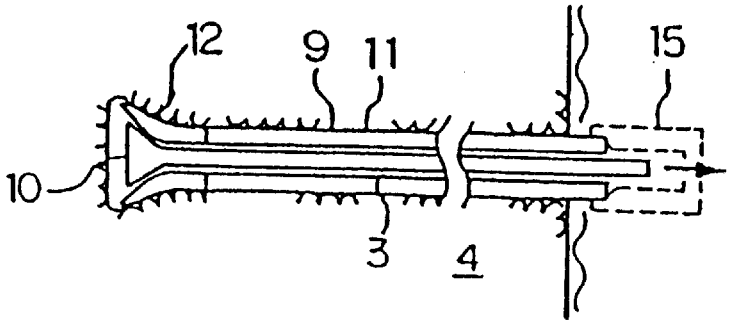
Fig. 12 PRIOR ART
FIG. 12 is a cross section showing the method of fixing the additional reinforcing material into the earth.
Figure 13:
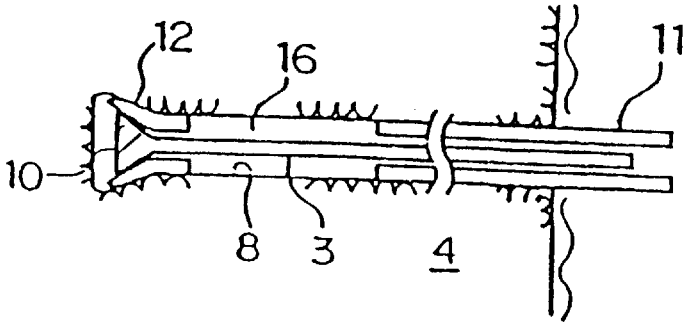
Fig. 13 PRIOR ART
FIG. 13 is a similar cross section showing the method of fixing the additional reinforcing material into the earth.
Figure 14:
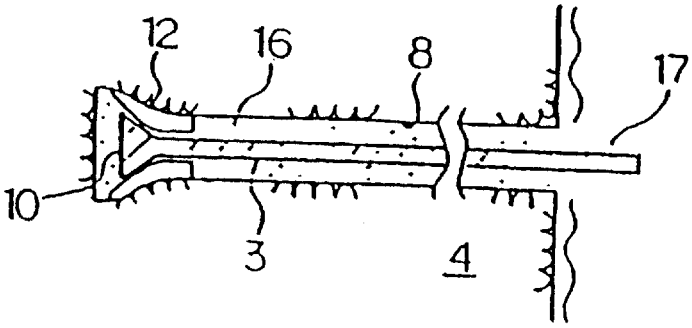
FIG. 14 is a similar cross section showing the method of fixing the additional reinforcing material into the earth.
Figure 15:
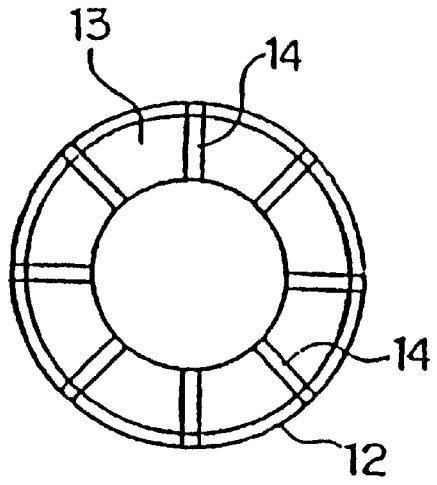
Fig. 15 PRIOR ART
FIG. 15 is a front view of the fixation pipe used to fix the tip of the additional reinforcing material.
Figure 16:
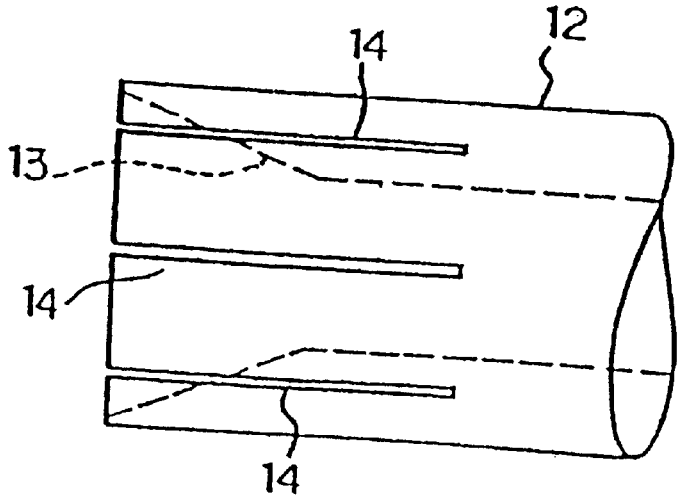
FIG. 16 is a similar side view of the fixation pipe.
Figure 17:
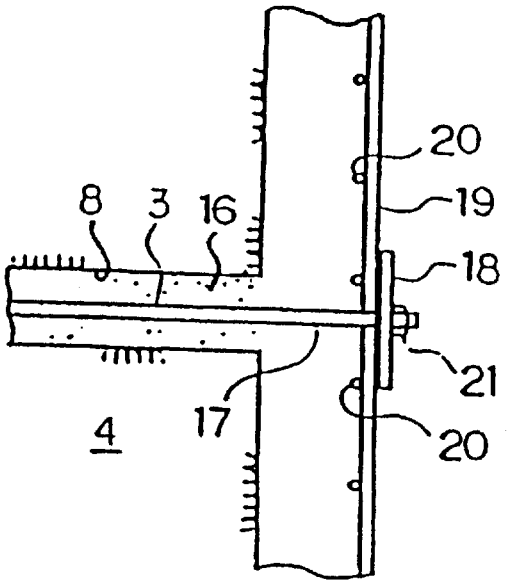
Fig. 17 PRIOR ART
FIG. 17 is a cross section of the connecting section of the tip of the additional reinforcing material and the reinforcing structure of the main foundation body.
Figure 18:
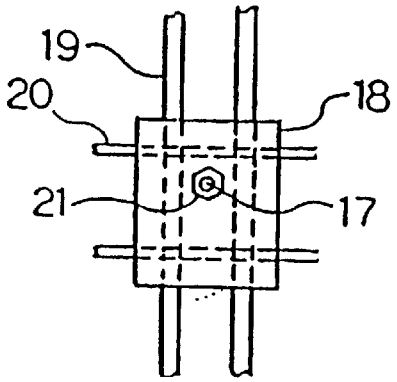
Fig. 18 PRIOR ART
FIG. 18 is a rear view of the fixed plate.
Figure 19:
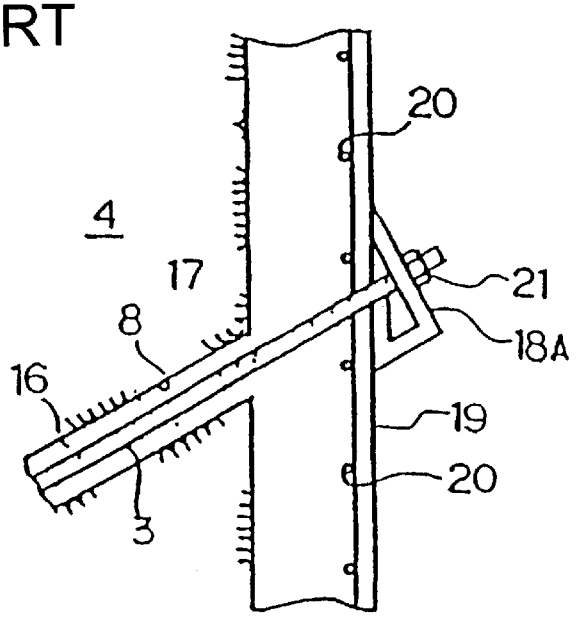
FIG. 19 is a cross section of the connecting section of the reinforcing structure of the main foundation body and the tip of the additional reinforcing material which is disposed in an inclining direction.
Figure 20:
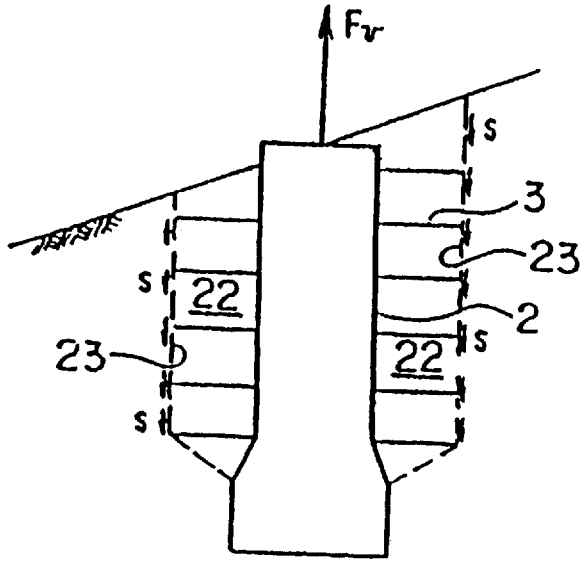
Fig.20 PRIOR ART
FIG. 20 is a cross section of the foundation body showing the underpinning structure of the foundation body with respect to detaching forces.
Figure 21:
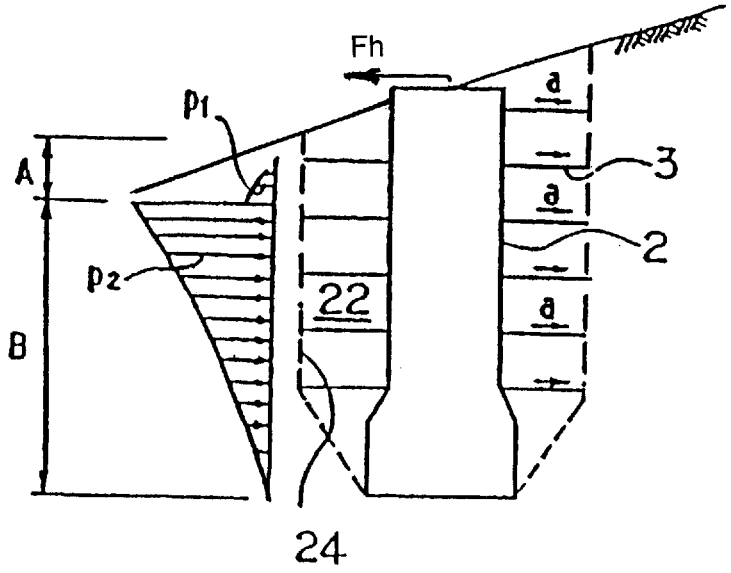
FIG. 21 is a cross section of the foundation body showing the underpinning structure of the foundation body with respect to horizontal forces.

Further, according to experimental models, the underpinning strength of the additional reinforcing materials 3 in the present invention is greatly enhanced to up to 1.8 times that of non-reinforced foundations. Therefore, in conventional foundations as shown in FIG. 9, eight additional reinforcing materials 3 are necessary in the direction of the outer periphery of the foundation body 1. However in the present invention, it is possible to obtain a sufficient underpinning strength with six additional reinforcing materials 3 as shown in FIG. 2 or even reduce to 4 additional reinforcing materials 3.

Figure 3:
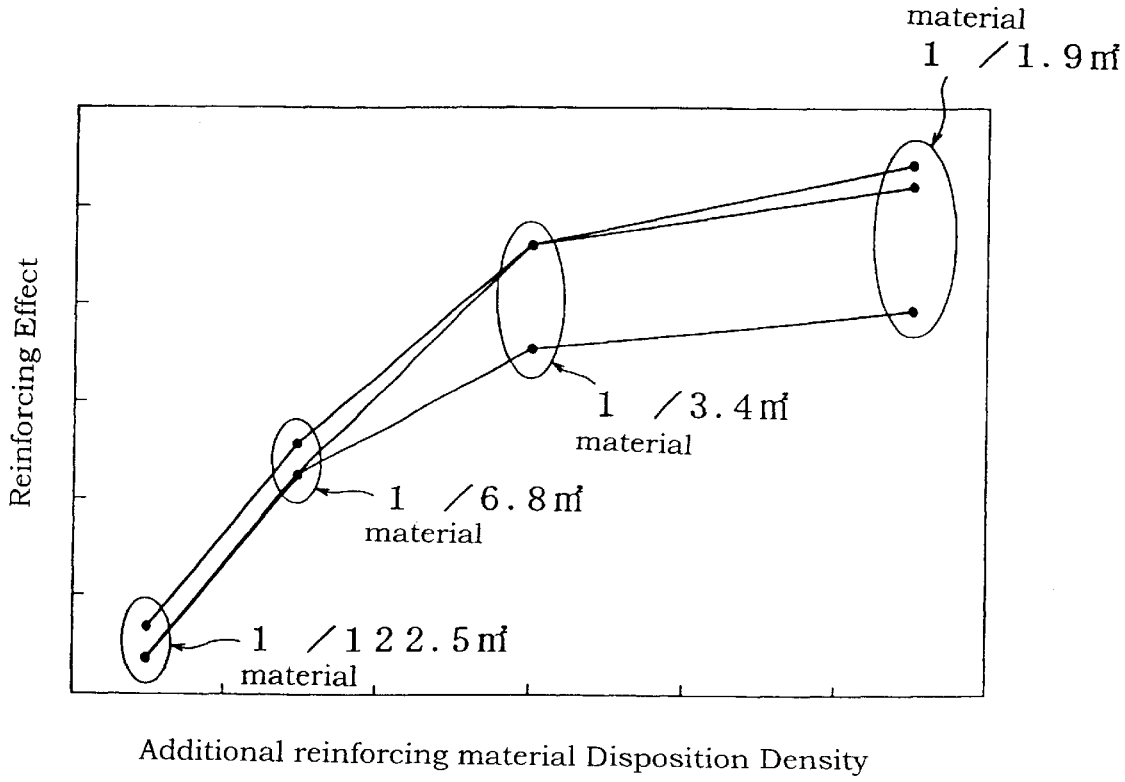
FIG. 3 shows the characteristics of the relation between the size of the reinforcing effect and the positional density of the additional reinforcing materials.

According to a simulation based on a calculation method of the reinforcing effect discussed below, when the additional reinforcing materials 3 are arranged at a ratio of one additional reinforcing materials 3 to about 3 square meters in the outer peripheral surface of the main foundation body 2, it is possible to efficiently obtain a maximum reinforcing effect with respect to the number of additional reinforcing materials 3. In other words, in the simulation as shown in FIG. 3, the density of arrangement of the additional reinforcing materials 3 on the outer peripheral face of the main foundation body 2 is successively increased from 1 member/122.5 $m^2$, 1 member/6.8 $m^2$, 1 member/3.4 $m^2$, 1 member/1.9 $m^2$. When a density of 1 member per about 3 square meters is exceeded, as increases in the size of the effective reinforcement saturate, it can be seen that the maximum effective density of the additional reinforcing materials 3 is one member per 3 square meters.

In this way, the reinforcing effect (the effect of the increase in confining pressure) due to the additional reinforcing materials 3 can be conspicuously improved by the disposal of the additional reinforcing materials 3 in the direction of minimum principal strain in the natural ground 4. This action will be explained below.

Figure 4:
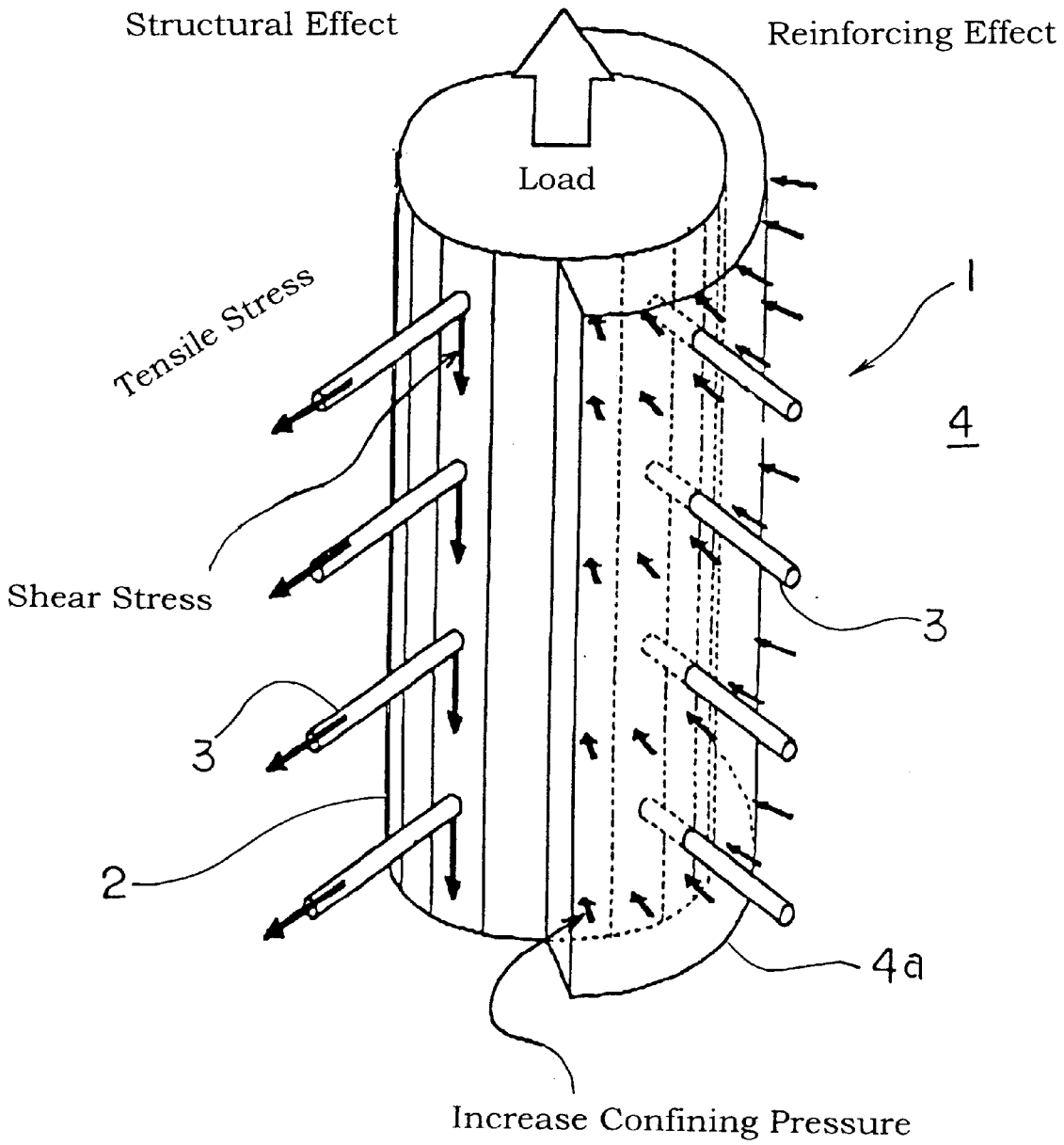
FIG. 4 is a vertical section to explain the structural effect and the effect of the reinforcing effect, which reinforce the underpinning strength of the foundation body.

As shown in FIG. 4, the reinforcing effect due to the foundation body 1 can be thought firstly the structural effect generated by the additional reinforcing materials 3 itself structurally apportioning a part of the shear stress and the tensile stress of the natural ground 4 and secondly the reinforcing effect being increased the rigidity of the body of natural ground 4 by the additional reinforcing materials 3 confining the tensile strain generated by the natural ground 4. The present invention improves the mechanical composition of the peripheral natural ground 4 and increases the reinforcing effect by the characteristic direction of displacement of the additional reinforcing materials 3.

Figure 5:
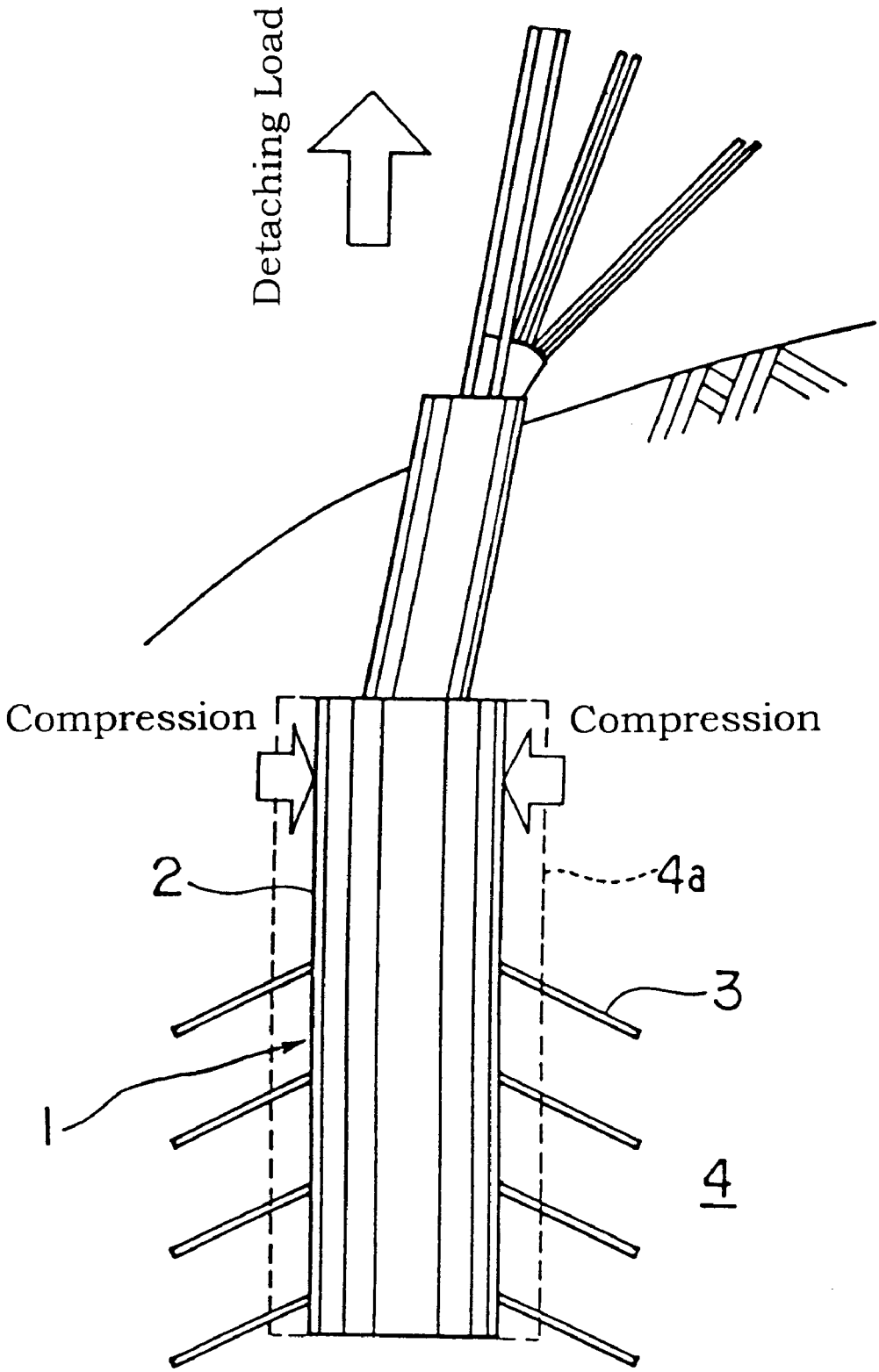
FIG. 5 is a vertical section showing the effect of detaching forces acting on the foundation body.

More specifically, as shown in FIG. 5, when the foundation body 1 undergoes detachment, the additional reinforcing materials 3 has the effect of pulling the natural ground 4*a* surrounding the foundation body 1 (shown by the broken line in the FIG. 5.) to the foundation body side 1. As a result, the natural ground 4*a* surrounding the foundation body 1 is compressed and the absolute value (expansion) of the increase $\Delta\epsilon_3$ in minimum strain when the natural ground 4 happens shear fracture is kept to a small value. Hence minimum principal stress $\sigma_3'$ increases. This increases shear strength $(\sigma_1'-\sigma_3')/2$ with respect to maximum principal stress $\sigma_1'$ and thus the natural ground 4 is strengthened. In this way, the reinforcing effect improves the base by suppressing actual dilatancy (dilation).

Therefore the increase in the underpinning strength as a result of the reinforcing effect is not achieved when the direction of the disposition of the additional reinforcing materials 3 is not corresponded to a flexible direction. The reinforcing effect is at a maximum when the additional reinforcing materials 3 is corresponded with the direction θ of increase of minimum principal strain in which the natural ground 4 happens shear fracture due to detaching forces.

Figure 6:
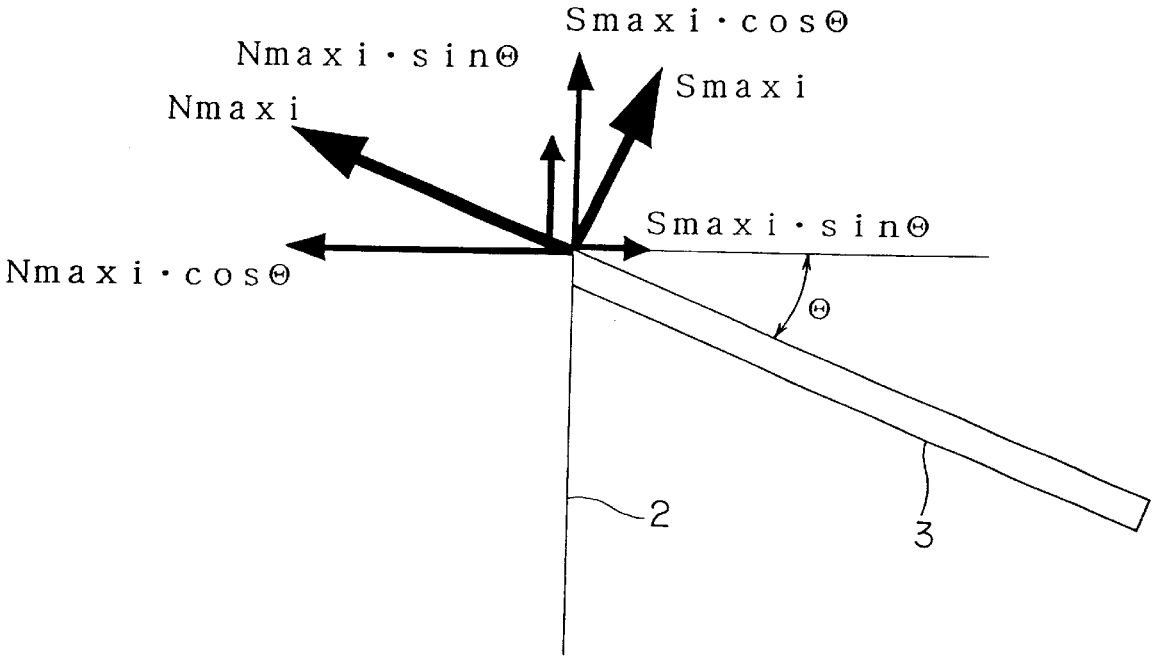
FIG. 6 explains the method of calculation of the reinforcing effect.

The method of calculating the reinforcing effect of the additional reinforcing materials 3 is explained with reference to FIG. 6.

In order to calculate the total reinforcing effect ΔP, firstly the increase in resistance ΔPs due to the structural effect is calculated by the formula below from the maximum axial strength $Nmax_i$ of one additional reinforcing material and the maximum shear force $Smax_i$ for one additional reinforcing material.

$$\Delta Ps=\Sigma(Smaxi.\ \cos\Theta+Nmax_i.\ \sin\Theta) \quad (1)$$

Above Θ is the angle of placement of the additional reinforcing materials 3. The total sum of all additional reinforcing materials 3 disposed in the main foundation body 2, in other words when there are n number of the additional reinforcing materials 3 becomes i=1~n.

Thus the increase in resistance ΔPr due to the reinforcing effect is calculated from the formula below from the maximum axial force $Nmax_i$ of one additional reinforcing material and the maximum shear force $Smax_i$ for one additional reinforcing material.

$$\Delta Pr=\Sigma(Nmax_i.\ \cos\Theta+Smax_i.\ \sin\Theta).\ \tan\Phi \quad (2)$$

Above Θ is the angle of placement of the additional reinforcing material. Φ is the inner frictional angle of the base. The total sum of all additional reinforcing materials 3 disposed in the main foundation body 2, in other words when there are n number of additional reinforcing materials 3 becomes i=1~n.

The total reinforcing effect ΔP is calculated from the increase in resistance ΔPs as a result of the structural effect and the increase in resistance ΔPr due to the reinforcing effect.

$$\Delta P=\Delta Ps+\Delta Pr \quad (3)$$

This calculation method is a correct calculation of the reinforcing effect has been confirmed experimentally by the use of a series of models.

The present invention enables conspicuous improvement in underpinning strength due to the reinforcing effect. At the same time the dimensions of the foundation body 1 are kept small. This is achieved by the disposition of additional reinforcing materials 3 in the direction of minimum principal strain in the natural ground 4 when a detaching force acts on the foundation body 1. Furthermore since the underpinning strength of each single additional reinforcing materials 3 is conspicuously increased, it is possible to place a number of about 5–9 additional reinforcing materials 3 stepwise, for example, in the outer periphery of the of the foundation body. Thus the cost of foundations is greatly reduced, the time required for their placement is reduced and to the degree the foundation body 1 is reduced in size, the amount of extracted earth is reduced.

Since the present invention in particular increases underpinning strength with respect to detaching forces, it is applicable to the foundation of high voltage electric towers which suffer from the problem of underpinning strength with respect to detaching forces from the upper section rather than from compressive underpinning forces.

Figure 7:
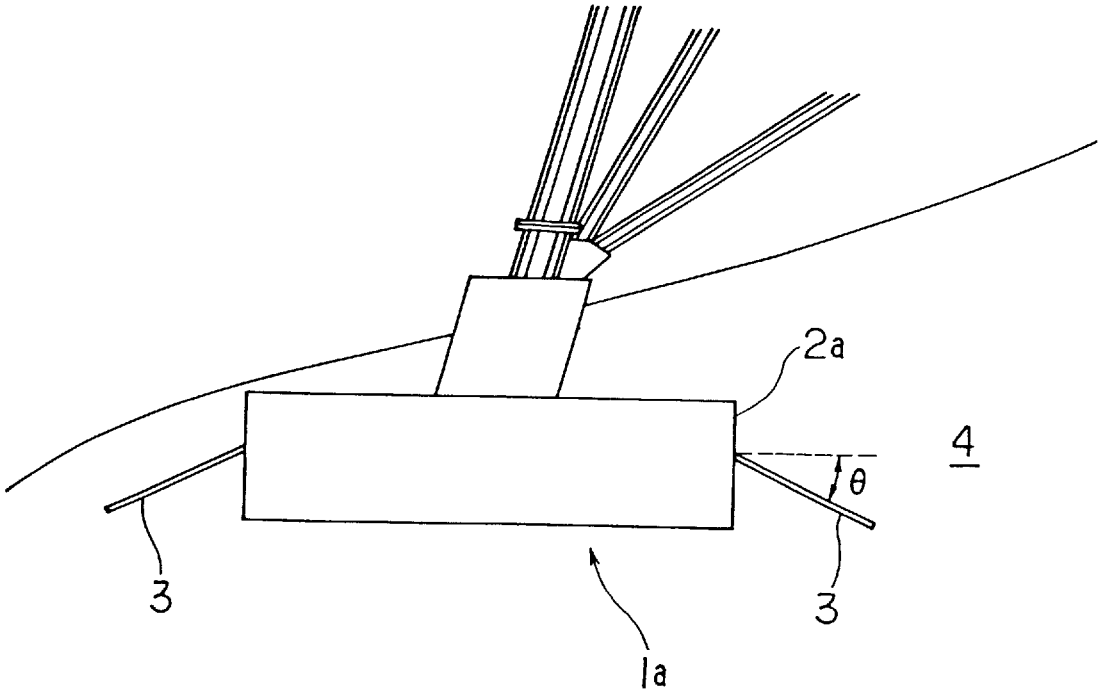
FIG. 7 is a vertical cross section schematically showing another aspect of the present invention.
Figure 8:
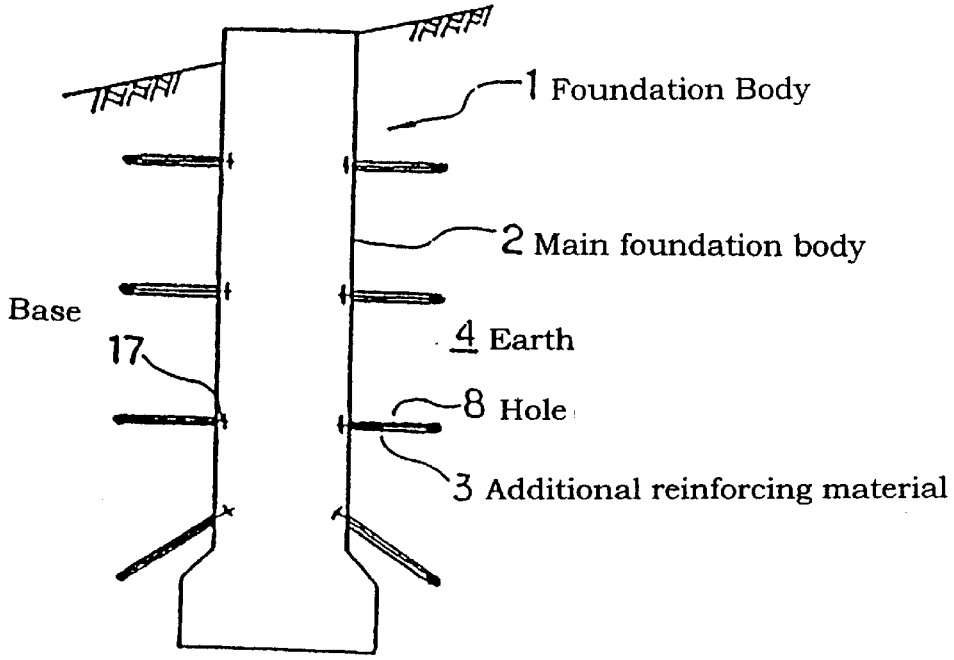
Fig.8 PRIOR ART
FIG. 8 is a vertical cross section showing a conventional foundation body.

FIG. 7 shows another embodiment of the present invention.

As shown in the figure, in this embodiment of the invention, in the foundation body 1*a,* the additional reinforcing materials 3 is only disposed in a single step in the axial direction of the main foundation body 2*a* with respect to the foundation body 1*a* which is short in the axial direction. In this kind of thin earth covering or so-called direct foundations, there is a conspicuous increase in the reinforcing effect due to the additional reinforcing materials 3 being constructed along the direction θ of minimum principal strain in the natural ground 4. This has been confirmed by simulations and model tests.

INDUSTRIAL APPLICABILITY

As shown above, the foundation body and method of disposing additional reinforcing materials in foundations with a reinforced base in the present invention can be used as foundation bodies and a method of disposing additional reinforcing materials in the foundations which experience problems of underpinning strength with respect to detachment forces from upper sections.

What is claimed is:

1. A method of forming foundations for base reinforcement in which a bore hole is formed into the earth from the excavation surface of the foundations, a main foundation body is constructed and a base of an additional reinforcing material of high rigidity is-fixed in said main foundation body after said additional reinforcing material is fixed in said bore hole characterized in that said additional reinforcing material is disposed so that the resistance of said foundation body with respect to detaching forces is increased by the structural apportioning by said additional reinforcing material of a part of the tensile strain and the shear strain with respect to the earth and therefore for each additional reinforcing material:

$$\Delta pr=(Nmax.\ \cos\Theta+Smax.\ \sin\Theta).\ \tan\Phi$$

where Nmax is the maximum axial force of said additional reinforcing material, Smax is the maximum shear force of said additional reinforcing material, Θ is the angle of placement of said additional reinforcing material, Φ is the inner frictional angle of said base) and wherein the above formula expresses the increase in resistance Δpr which is maximized by the disposition of said additional reinforcing materials and wherein said resistance of the peripheral earth with respect to the detaching forces on the foundation body is increased as a result of an increase in the confining pressure due to said additional reinforcing material drawing the peripheral earth towards said main foundation body and said peripheral earth pushing said main foundation body wall face.

2. A method of disposing additional reinforcing materials in foundations formed with a reinforced base as defined in claim 1 characterized in that said additional reinforcing material is oriented to correspond with the direction of minimum principal strain in the earth which is the direction in which tensile axial force of said additional reinforcing material is at a maximum when the detaching forces act on said foundation body.

3. A method of disposing additional reinforcing materials in foundations formed with a reinforced base as defined by claim 1 characterized in that a plurality of additional reinforcing materials is provided and is disposed at roughly equal intervals about the entire outer periphery of the main foundation body.

4. A method of disposing additional reinforcing materials in foundations formed with a reinforced base as defined by claim 1 characterized in that said additional reinforcing material has a length about ⅔ that of the diameter of said main foundation body.

5. A method of disposing additional reinforcing materials in foundations formed with a reinforced base as defined by claim 1 characterized in that said additional reinforcing materials are disposed on the outer periphery of said main foundation body at a rate of one per every three square meters.

6. A method of disposing additional reinforcing materials in foundations formed with a reinforced base as defined by claim 1 characterized in that said main foundation body used is short in length in the axial direction and said additional reinforcing materials are disposed stepwise in the axial direction of said main foundation body.

* * * * *